US006033816A

United States Patent [19]

Luo et al.

[11] Patent Number: 6,033,816

[45] Date of Patent: Mar. 7, 2000

[54] ELECTROPHOTOGRAPHIC PHOTORECEPTORS WITH CHARGE GENERATION BY POLYMER BLENDS

[75] Inventors: Weimei Luo, Boulder; Kasturi Rangan Srinivasan, Niwot, both of Colo.; Julie Corrin House, San Diego, Calif.

[73] Assignee: Lexmark International, Inc., Lexington, Ky.

[21] Appl. No.: 08/970,823

[22] Filed: Nov. 14, 1997

[51] Int. Cl.[7] ..... G03G 5/047; G03G 5/05

[52] U.S. Cl. ..... 430/59.5; 430/78; 430/96

[58] Field of Search ..... 430/96, 58, 59, 430/78, 59.5

[56] References Cited

U.S. PATENT DOCUMENTS

| | | | |
|---|---|---|---|
| 4,439,507 | 3/1984 | Pan et al. | 430/59 |
| 4,490,452 | 12/1984 | Champ et al. | 430/58 |
| 4,725,519 | 2/1988 | Suzuki et al. | 430/58 |
| 4,818,650 | 4/1989 | Limburg et al. | 430/56 |
| 4,933,244 | 6/1990 | Teuscher et al. | 430/58 |
| 4,956,440 | 9/1990 | Limburg et al. | 528/99 |
| 4,983,483 | 1/1991 | Tsai | 430/59 |
| 5,215,844 | 6/1993 | Badesha et al. | 430/96 |
| 5,232,800 | 8/1993 | Pavlisko et al. | 432/58 |
| 5,240,801 | 8/1993 | Hayashi et al. | 430/57 |
| 5,248,578 | 9/1993 | Takaoka et al. | 430/58 |
| 5,252,417 | 10/1993 | Tokida et al. | 430/78 |
| 5,266,431 | 11/1993 | Mammino et al. | 430/96 |
| 5,320,923 | 6/1994 | Nguyen | 430/78 |
| 5,506,081 | 4/1996 | Terrell et al. | 430/58 |
| 5,529,869 | 6/1996 | Nguyen | 430/78 |
| 5,578,406 | 11/1996 | Ojima et al. | 430/83 |
| 5,688,620 | 11/1997 | Fujita et al. | 430/96 |
| 5,753,395 | 5/1998 | Kinoshita et al. | 430/78 |

FOREIGN PATENT DOCUMENTS

| | | | |
|---|---|---|---|
| 0 180 930 A2 | 5/1986 | European Pat. Off. | G03G 5/06 |
| 0 295 126 A2 | 12/1988 | European Pat. Off. | C08G 59/64 |
| 0 708 374 A1 | 4/1996 | European Pat. Off. | G03G 5/06 |
| 0 795 791 A1 | 9/1997 | European Pat. Off. . | |
| 62-229251 | 10/1987 | Japan | 430/96 |
| 3-53258 | 3/1991 | Japan | 430/58 |
| 6-289629 | 10/1994 | Japan | 430/96 |
| 2 231166 | 11/1990 | United Kingdom | G03G 5/06 |

OTHER PUBLICATIONS

Patent & Trademark Office English–Language Translation of JP 62–229251 (Pub Oct. 1987).

Patent & Trademark Office English–Language Translation of JP 3–53258 (Pub Mar. 1991).

Patent & Trademark Office English–Language Translation of JP 6–289629 (Pub Oct. 1994).

Derwent Abstract AN 87–189355 of JP 62119547 (Pub May 1987).

Derwent Abstract AN 89–274135 of JP 01198762 (Pub Aug. 1989).

Derwent Abstract AN 91–189181 of JP 03116152 (Pub May 1991).

Derwent Abstract AN 92–036561 of JP 03282554 (Pub Dec. 1991).

Derwent Abstract AN 91–003310 of JP 02280169 (Pub Nov. 1990).

Derwent Abstract AN 91–212626 of JP 03136064 (Pub Jun. 1991).

Derwent Abstract AN 91–242862 of JP 03158862 (Pub Jul. 1991).

Derwent Abstract AN 81–68913D of JP 56097352 (Pub Aug. 1981).

1994–1995 Aldrich Chemical Catolog, p. 1173.

*Primary Examiner*—Janis L. Dote

*Attorney, Agent, or Firm*—John A. Brady

[57] ABSTRACT

A photoconductive drum of an aluminum substrate and a blend of polyvinylbutyral and one or a blend of phenoxy resin, epoxy novolac resin, and epoxy capped polymers which are derivatives of bisphenol and epichlorohydrin. The blend enhances the electrical properties.

4 Claims, No Drawings

ELECTROPHOTOGRAPHIC PHOTORECEPTORS WITH CHARGE GENERATION BY POLYMER BLENDS

TECHNICAL FIELD

This invention relates to improved photoconductive elements for electrostatic imaging. More specifically, this invention pertains to charge generation binders (polymers) of blends with polyvinylbutyral to enhance the electrical characteristics, i.e. increased sensitivity, and decreased dark decay. This invention seeks improvement in the electrical characteristics derived by the use of the binder, rather than increasing the pigment or charge transport molecule in the formulation.

BACKGROUND OF THE INVENTION

An organic photoconductor typically comprises an anodized layer on a conductive subtrate such as aluminum drum or a barrier layer, a charge generation layer (CGL) and a charge transport layer (CTL). The charge generation layer is made of a pigment, such as metal free or metal-phthalocyanine, squaraine, bisazo compound or a combination of a bisazo and trisazo compounds. The mechanical integrity to a charge generation (CG) layer is often derived from a polymeric support. Various polymer binders have been used for this purpose. Some of these polymers are polyvinylbutyral, polycarbonates, epoxy resin, polyacrylate, polyesters, phenoxy resin, phenolic resins to name a few. In the case of phthalocyanines, polyvinylbutyrals (PVBs) have been the polymers of choice. This polymer may be used in combination with other polymers. Although the patent literature abounds in a number of publications with respect to the use of PVB, and a mention of phenoxy resin as a supporting binder, no mention is made of the role of the phenoxy resin, or the use of blends corresponding to phenoxy, epoxy or epoxy novolac resin with PVB. This invention focuses on the improved electrical properties derived from the phenoxy resin, epoxy resin or epoxy novolac resins, when used as a supporting polymer binder in the charge generation layer. The improved electrical characteristics relate to improved dark decay and sensitivity, while retaining good adhesion (with respect to PVB) and structural integrity.

Phenoxy resins have been reported to serve as polymer binders for bisazo pigments. EP 708 374 A1 (1996) demonstrates the use of a phenoxy resin as a binder for a bisazo pigment. The authors refer to some agglomeration in some of the dispersion formulation based on the phenoxy resin, but attributed this to the combination of the coupler residue and the azo pigment. Some of the other patents relating to either a use or a possible use of the phenoxy resins as binders with bisazo pigments are JP 03158862 A (1991), JP 03116152 A (1991) and JP 01198762 A (1989). The Japanese patent 03282554 A (1991) demonstrates the use of a phenoxy resin as a binder for a metal-free phthalocyanine and using 1,1,2-trichloroethane as a solvent. Other patents pertaining to the phthalocyanine based phenoxy resin formulations include JP 02280169 A (1990), GB 2 231 166 A (1990), U.S. Pat. No. 4,983,483 (1993) to name a few. Limburg et al. (EP 295 126 A2, 1993 and U.S. Pat. No. 4,818,650, 1987 have discussed the use of a polyarylamine phenoxy resin as part of the charge transport layer in the preparation of a photoreceptor. The above photoreceptor was shown to exhibit improved resistance to cracking during mechanical cycling. Phenoxy resin based polymers have also been used as undercoats in the preparation of photoconductors (e.g. JP 03136064 A, 1991).

The use of the phenoxy resin as a binder is hence fairly well known. However, it was surprising to note in this invention, that the phenoxy resin can be used to improve the electrical characteristics of the photoconductor. The use of the phenoxy resin as blends results in improved electrical characteristics, without having to increase either the pigment or charge transport molecule concentration, which in turn relates to lower cost of the resulting photoconductor drum. The use of the polymer in formulations investigated in this invention has not been reported in the patent literature. The importance of this invention can be extended to the use of the phenoxy resins in the preparation of photoconductors required for high speed printer applications which would require high sensitivities, low dark decays and use in any environmental condition (ambient, hot/humid or cold/dry). The dark decay for these formulations improve by 5–40%, the change in electricals in various environments is usually less than 35 V and the sensitivity measured at most energies are improved, in comparisons to photoconductors comprising of PVB as CG binder only.

The inventors found that the use of the phenoxy resins as a pure binder results in highly unstable dispersions of the titanyl phthalocyanine and hence cannot be used in the coating process of photoconductor drums. However, the use of the phenoxy resins as a blend with PVB, results in stable dispersions and the resulting photoconductor drums are found to exhibit superior electrophotographic properties such as low dark decay's and high electrical sensitivity's.

The use of epoxy novolac resins as a binder polymer in the charge generation layer of an electrophotographic photoreceptor is not known in patent literature. Epoxy resins have been used in the preparation of barrier layers, adhesive layers and charge generation layers. In a similar manner, phenolic resins have been shown to improve the adhesion of the CG layer to the aluminum core. Epoxy-novolac resins are essentially a combination of the epoxy resins and the phenolic resins. The resin system can be cross-linked either chemically or thermally. The cross-linked resins usually result in enhanced mechanical properties in comparison to their precursors. The thermal cross-linking reaction can essentially be brought about during the curing of the CG layer. The chemical cross-linking may be brought about by the addition of catalysts such as titanium alkoxides. The epoxy functionality and the phenolic functionality not only impart good mechanical integrity to the charge generation binder, but also improved adhesion of the CG layer to the aluminum core.

Several patents in the literature refer to the epoxy resins as possible in binders in the sub-layer, charge generation or charge transport layers. For example, U.S. Pat. No. 5,240,801, 1993 lists the epoxy resin as a polymer for a protective coat layer. JP 621194257 A, 1987 suggests the use of epoxy resin as a binder for an oxazole charge transport molecule. EP 180 930 A2 (1986) (Mitsubishi Chem. Ind.) lists several binders for CG layer of which polyvinylbutyral and epoxy resin are two of them. JP 56097352 A, 1981 lists binders in a general manner as those derived from addition or condensation reactions and refer to the epoxy resins as an example.

DISCLOSURE OF THE INVENTION

In summary, it may be concluded that:

a) An electrophotographic photoconductor drum may be prepared using a blend of polyvinylbutyral and phenoxy resin, epoxy novolac resins, or epoxy resins in the CG formulation or layer by a dip-coating process, followed by a charge transport layer coating, with enhanced electrical sensitivity and decreaed dark decay of the photoconductor. The charge transport layer comprises a resin having a charge transport molecule dispersed therein.

b) The above resins may be used as blends with polyvinylbutyral (for example), at levels of 5–95% by weight of the polymer binder. The CG systems thus formed, result in improved electrical characteristics with various charge transport molecules namely, benzidines and hydrazones, and may be used with other transport molecules such as arylamines.

c) The dispersions prepared are stable for extended periods and result in good coating quality.

d) The photoconductor drums show good environmental stability with respect to their electricals and print quality e) The molecular weight of the phenoxy resins may be in the range of 7,000–16,000 g/mol number average molecular weight.

f) The epoxy novolac resins may have a number average molecular weight of 400–1300 g/mol, and may be substituted with groups such as hydrogen, methyl etc.

g) The epoxy resins may have a molecular weight of 3,000–10,000 g/mol weight average molecular weight.

DESCRIPTION OF THE PREFERRED EMBODIMENTS

One embodiment of the present invention comprises a photoconductive member comprising a conductive substrate, a charge generation layer and a charge transport layer on the charge generation layer and having a charge transport molecule dispersed therein. Preferably, the charge generation layer consists essentially of a blend of oxotitanium phthalocyanine pigment, polyvinylbutyral and an epoxy capped polymer which is a derivative of bisphenol and epichlorohydrin, wherein the harge generation layer has a pigment to binder weight ratio of from 35/65 to 45/55. More preferably, the epoxy capped polymer has a formula of:

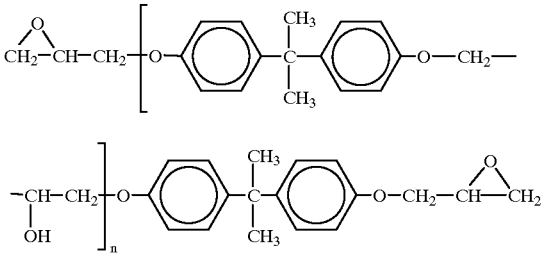

where n is an integer. Preferably, the above epoxy capped polymer has a weight average molecular weight of from 4,294 to about 26,869. More preferably, the polymer has a molecular weight of from 6,782 to about 26,869. In another preferred embodiment, the polyvinylbutyral and epoxy capped polymer are used in a weight ratio of about 75/25 to about 10/90 of polyvinylbutyral to epoxy capped polymer.

In another embodiment, the present invention comprises a photoconductive member comprising a conductive substrate, a charge generation layer and a charge transport layer on the charge generation layer and having a charge transport molecule dispersed therein. Preferably, the charge generation layer consists essentially of a blend of oxotitanium phthalocyanine pigment, polyvinylbutyral and an epoxy novolac resin, wherein the charge generation layer has a pigment to binder weight ratio of from 35/65 to 45/55. Preferably, the polyvinylbutyral and epoxy novolac resin are used in a weight ratio in a range of about 90/10 to about 25/75 polyvinylbutyral to epoxy novolac resin. Unless otherwise specifically stated, the materials of this specification have the following structure.

BX-55Z and BM-S polyvinylbutyral (PVB):

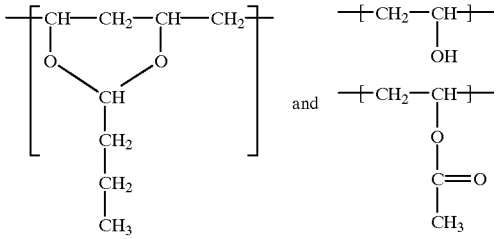

Number Ave. molecular Wt.: 98,000 g/lmol

PHENOXY RESINS

PKHH, PKHJ, PKHM and PKFE phenoxy resin:

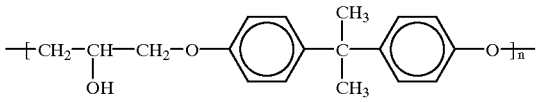

where n~38–60

Number Ave. Molecular Wt.:

PKHH: 11,000 g/mol

PHHJ: 12,000 g/mol

PKHM: 7,000 g/mol

PKFE: 16,000 g/mol

EPOXY NOVOLAC RESINS

P(GE-F): poly[(phenylene glycidylether)-co-formaldehyde]

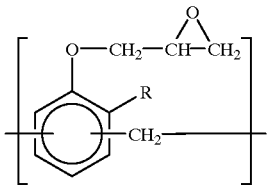

R=H or $CH_3$ where R=H; resin is P(GE-F) above where R—$CH_3$, resin is poly[(o-cresyl glycidylether)-co-formaldehyde].

Number Ave. molecular Wt.: about 600–1270 g/mol

PC(GE-DCP): poly[phenylene glycidylether-co-dicyclopentadiene]

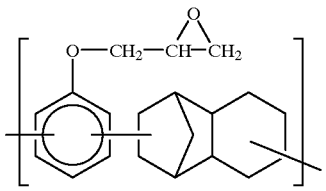

Number Ave. molecular Wt.: about 490 g/mol

EPOXY RESINS

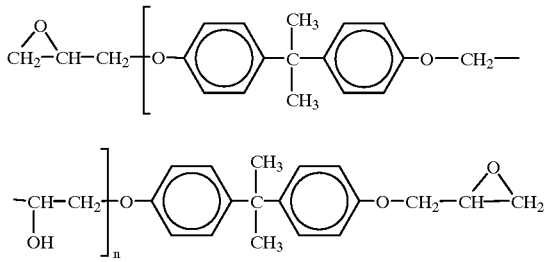

n=an integer consistent with the molecular weight of the resin

Wt. Ave. Molecular Weight:

EPON 1001: 4,294 g/mol

EPON 1004: 6,782 g/mol

EPON 1009: 26,869 g/mol

BENZIDINE:

N,N$^1$-bis(3-methylphenyl)-N,N$^1$-bisphenylbenzidine

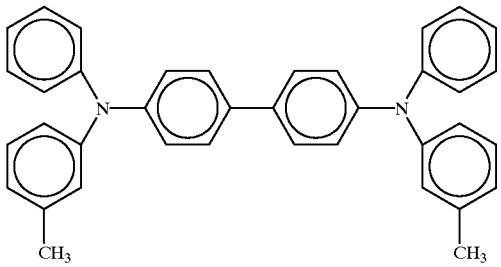

DEH

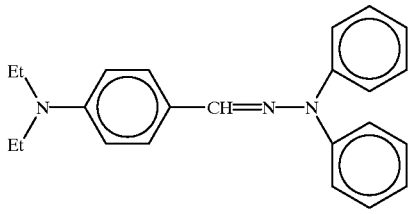

POLYCARBONATE: MAKROLON—5208 polycarbonate

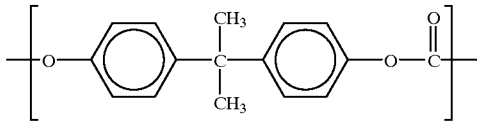

APEC 9201 polycarbonate

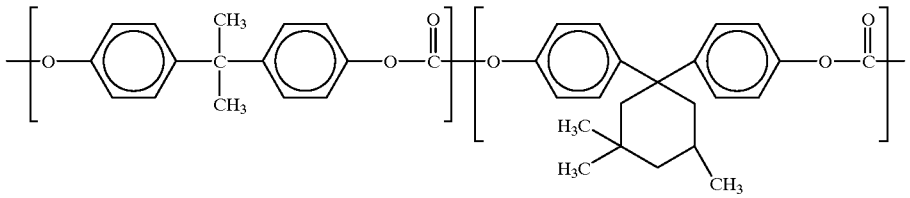

The term "blend" is used in the normal sense of a thorough mixture.

The phenoxy resins with number average molecular weight, Mn: 7,000–16,000 g/mol (average molecular weight, Mw: 40,000–80,000) were used as blends with polyvinylbutyral (BX-55Z and BM-S, Sekisui Chemical Co.). This work pertains to the use of the phenoxy resins (PKHH, PKHJ, PKHM and PKFE; Phenoxy Associates, S.C., Phenoxy Resin: Scientific Polymer Products, New York) as blends in charge generation formulations. A formulation consisting of 45/55 pigment (oxotitanium phthalocyanine) to binder, showed improved dark decay and electrical characteristics when the PVB binder was suitably blended with the phenoxy resin. The weight ratios used were 75/25, 25/75 and 10/90 of PVB/phenoxy resin. The dispersions were stable for the PVB/phenoxy blends. All data presented below correspond to the use of the same transport formulation, namely a polycarbonate (MAKROLON-5208, Bayer) and 30% benzidine (N,N'-bis(3-methylphenyl)-N,N'-bisphenyl-benzidine) at 20% solids in a mixture of tetrahydrofuran and 1,4-dioxane.

In contrast, the use of phenoxy resin without any PVB as binder for the oxotitanium phthalocyanine resulted in an unstable dispersion (phase separation). The PVB/phenoxy blends (75/25) resulted in good coating quality for the CG layer, whereas the higher phenoxy resin blends (75/25 phenoxy/PVB) required the drums to be double-dipped to obtain optimum optical densities in the CG layer, when coated at 3% solids, although at 6% solids the CGs required a single-dip. The CG layers were coated with a benzidine-polycarbonate transport layer with a cure at 120° C. for 1 h, to a coat weight of about 20 mg/in$^2$. The adhesion of the CG layer to the aluminum drum core was improved with the higher temperature cure, exhibiting similar or improved adhesion of the coatings to the core in comparison to the standard BX-55Z based formulations. In comparison to the BX-55Z PVB as CG binder, the phenoxy resin blends with BX-55Z showed improved electrical characteristics. The dark decay—time data and the electrical characteristics for the blends at various cure conditions are shown in Tables 1 and 2, respectively.

TABLE 1

Variation of Dark Decay with Time: BX-55Z/Phenoxy Resins (75/25);(45/55) Pigment/Binder

| CG BINDER (CURE) | Dark Decay (V/sec) 1 sec | 10 sec | 30 sec | 60 sec |
|---|---|---|---|---|
| BX55Z (100C/5 min) | 26 | 129 | 219 | 305 |
| BX55Z/PKHH (Amb. Cure) | 26 | 139 | 267 | 379 |
| BX55Z/PKHH (50C/5 min) | 19 | 72 | 142 | 214 |
| BX55Z/PKHH (100C/5 min) | 22 | 81 | 145 | 212 |
| BX55Z/PKHJ (Amb. Cure) | 22 | 80 | 147 | 213 |
| BX55Z/PKHJ (50C/5 min) | 20 | 73 | 138 | 200 |
| BX55Z/PKHJ (100C/5 min) | 20 | 85 | 145 | 218 |

TABLE 2

Electrical Characteristics of BX-55Z/Phenoxy Resins (75/25); (45/55 Pigment/Binder)

| CG BINDER (CURE) | Charge Voltage (−Vo) | $V_{0.23}$ (−V) |
|---|---|---|
| BX-55Z (100C/5 min) | 658 | 157 |
| BX-55Z/PKHH (Amb. Cure) | 638 | 105 |
| BX-55Z/PKHH (50/5 min) | 643 | 112 |
| BX-55Z/PKHH (100C/5 min) | 645 | 110 |
| BX-55Z/PKHJ (Amb. Cure) | 643 | 105 |
| BX-55Z/PKHJ (50C/5 min) | 645 | 105 |
| BX-55Z/PKHJ (100C/5 min) | 645 | 112 |

$V_{0.23}$: Voltage at an Energy of 0.23 uJ/cm2
All phenoxy resin blends had optical density of about 1.30

In order to test the hypothesis that the phenoxy resin had a role in the improved electrical characteristics, a formulation was made such that the pigment concentration was decreased, namely, 35% instead of 45%. The results were identical to the 45/55 pigment/binder ratio. The photoconductor drums exhibited lower dark decays and improved electrical characteristics. The dark decay and sensitivities were substantially improved for the higher phenoxy resin ratios. The electrical response characteristics are shown in Table 3:

TABLE 3

Electrical Characteristics: BX-55Z/Phenoxy Resins; (35/65 Pigment/Binder)

| CG BINDER | Charge Voltage (−Vo) | $V_{0.23}$ (−V) |
|---|---|---|
| BX-55Z | 658 | 237 |
| BX-55Z/PKHH (75/25 | 658 | 188 |
| BX-55Z/PKHJ (75/25) | 658 | 180 |
| BX-55Z/PKHH* (25/75) | 658 | 122 |
| BX-55Z/PKHJ* (25/75) | 660 | 116 |

*Drums were double-dipped in CG formulation
All drums had optical density of 1.30–1.40
$V_{0.23}$: Voltage at an Energy of 0.23 uJ/cm2

An extension of this work was to study the effect of the phenoxy resin on low molecular weight PVB. The resin chosen for this purpose was the BM-S PVB (Sekisui Chemical Co., Mn of 48000 g/mol) which has a lower molecular weight than the BX-55Z PVB (Mn of 98000 g/mol). The blends prepared were the 75/25 and the 25/75 of BM-S/phenoxy resin, respectively. The CG dispersions involving the blends were stable and gave good coating quality. The dark decay and electrical characteristics were improved, more significantly for the drums that were double-dipped in the CG formulation (for optimum properties, proper choice of the optical density was critical), in comparison to the BM-S standard formulation. As is evident from the electrical characteristics in Table 4, the sensitivity of the drums are increased if the drums are double-dipped in the CG layer coating process, which in turn correspond to higher optical densities.

TABLE 4

Electrical Characteristics: BM-S/Phenoxy Resins (45/55 Pigment/Binder)

| CG BINDER | Charge Voltage (−Vo) | $V_{0.23}$ (−V) |
|---|---|---|
| BM-S | 658 | 117 |
| BM-S/PKHH (75/25) | 658 | 135 |
| BM-S/PKHJ (75/25 | 658 | 142 |
| BM-S/PKHH* (75/25) | 650 | 82 |
| BM-S/PKHJ* (75/25) | 653 | 85 |
| BM-S/PKHH (25/75) | 658 | 163 |
| BM-S/PKHJ (25/75) | 658 | 160 |
| BM-S/PKHH* (25/75) | 657 | 85 |
| BM-S/PKHJ* (25/75) | 657 | 83 |

*Drums were double-dipped in CG formulation, optical density of 1.35, optical density of all others was 1.20
$V_{0.23}$: Voltage at an Energy of 0.23 uJ/cm2

Formulations containing a (bisphenol-TMC-co-bisphenol-A) polycarbonate [(BPTMC-co-BPA)PC, APEC 9201, Bayer]-benzidine transport solution were coated on a standard CG layer (BX-55Z) and the phenoxy resin/BX-55Z blend, and interestingly the phenoxy resin drums exhibited lower dark decays and improved electrical behavior. The electrical characteristics for the PVB/(bisphenol-TMC-co-bisphenol-A) polycarbonate are shown in Table 5.

Another significant improvement in the use of the phenoxy resin was the limited fluctuation in the electrical characteristics at various environmental conditions.

The drums formulated with the phenoxy resin/PVB blends were subjected to different conditions, such as ambient, hot/humid and cold/dry. The electrical response stability at different environments is evident in the phenoxy resin blends, as seen in Table 5.

TABLE 5

Electrical Characteristics for the CG/CT binders

| CG BINDER | AMBIENT (72F/40% RH) $-V_0$ | $-V_{0.23}$ | COLD/DRY (60F/08% RH) $-V_0$ | $-V_{0.23}$ |
|---|---|---|---|---|
| BX55Z//(BPTMC-co-BPA)PC | 658 | 185 | | |
| BX55Z/PKHH (75/24)// (BPTMC-co-BPZ)PC | 662 | 145 | | |
| BX55Z (45/55, PIGMENT/BINDER) | 658 | 192 | 645 | 225 |
| BX55Z/PKHH (25/75) | 647 | 112 | 642 | 140 |
| BX55Z/PKHJ (25/75) | 647 | 115 | 642 | 152 |
| BX55Z (35/65, PIGMENT/BINDER) | 658 | 237 | 660 | 282 |
| BX66Z/PKHH (25/75) | 658 | 122 | 660 | 155 |

A significant improvement in the electrical behavior at various environments is further manifested in the print quality that one obtains for the photoconductor under these environmental conditions. In contrast to the standard BX55Z based formulation, the phenoxy resin blends, exhibited good isopel optical density (O.D.) and single pel 20 performance at ambient, hot/humid and cold/dry conditions. For example while the isopel O.D. for BX55Z at ambient, and cold/dry were 0.31 and 0.18, those for the phenoxy resin blend (25/75 BX55/PKHH) were 0.62 and 0.32. Print quality is usually improved if the isopel O.D. is high and the loss of single pel in cold/dry conditions is not observed for the phenoxy resin blends.

The epoxy novolac resins used as blends were poly [(phenylene glycidyl ether)-co-formaldehyde] [P(GE-F)] (Mn of~605) and poly[(phenylene glycidyl ether)-co-dicyclopentadiene] [P(GE-DCP)] (Mn of~490) with PVB (S-Lec-B [BX-55Z and BM-S], Sekisui Chemical Co.). Formulations consisting of 45/55 pigment (oxotitanium phthalocyanine) to binder, showed improved dark decay and electrical characteristics when the PVB binder was blended with epoxy novolac resin. The blends were prepared at weight ratios of 90/10, 75/25, 50/50 and 25/75 of the PVB to the epoxy novolac resin. All stable formulations resulted in good coating quality. The CG layers involving the above formulations were typically cured at 100° C. for 5 min. The charge transport (CT) layers coated on the CG layers were benzidine-polycarbonate and cured at 120° C. for 1 h, to a coat weight of about 20 mg/in2. The electrical characteristics of drums coated with the above formulations are given in Table 6.

As is evident from Table 6, the addition of the epoxy novolac resin in the CG layer improves the electrical sensitivity and the dark decay. Another significant improvement derived from this system, is the stability of the photoconductor drum's electricals at different environmental conditions. While more often than not, the electricals slow down to a large extent in a cold/dry condition (60° F./08% relative humidity), the epoxy novolac resin blends show a small variation and result in better print quality [background and the isopel optical density (Isopel O.D.)] in comparison to the non-epoxy novolac resin blend. In most cases, the electrical discharge voltage at an energy of 0.23 uJ/cm2 show a variation of about 20–30 V with the change in environment (72° F./40% RH to 60° F./08% RH), and the photoconductor exhibits better sensitivity than the non-epoxy novolac resin drum at ambient condition (72° F./40% RH).

In order to test the theory that the improved electricals were derived from the use of the epoxy novolac resin, that resin was blended with a lower molecular weight PVB, namely BM-S (Mn of 48000 g/mol). The results were identical to the BX-55Z formulation experiment, i.e. improved electrical sensitivity and dark decay (Table 7).

TABLE 6

Electrical Characteristics of Epoxy Novolac Resin CG Blends with Benzidine Transport (45% Pigment and 30% Transport concentrations)

| Binder (Charge Generation Layer) | Environment | Optical Density | Charge (−V) | Discharge (−V) | Dark Decay (V/sec) | Back-ground | Isopel O.D. |
|---|---|---|---|---|---|---|---|
| BX-55Z | Ambient* | 1.55 | 662 | 192 | 18 | 0.45 | 0.29 |
| | cold/dry** | | 662 | 225 | | 0.35 | 0.18 |
| BX-55Z/P | Ambient | 1.36 | 658 | 147 | 25 | 0.61 | 0.42 |
| (GE-DCP) (90/10) | cold/dry | | 645 | 195 | | 1.23 | 0.22 |
| BX-55Z/P | Ambient | 1.24 | 662 | 90 | 21 | 0.62 | 0.56 |
| (GE-DCP) (75/25) | cold/dry | | 663 | 110 | | 0.32 | 0.35 |
| BX-55Z/P | Ambient | 1.38 | 662 | 82 | 20 | 0.45 | 0.64 |
| (GE-DCP) (50/50) | cold/dry | | 660 | 102 | | 0.49 | 0.37 |
| BX-55Z/P | Ambient | 1.33 | 663 | 100 | 12 | 0.37 | 0.55 |
| (GE-DCP) (25/75) | cold/dry | | 662 | 135 | | 0.59 | 0.29 |
| BX-55Z/P | Ambient | 1.36 | 663 | 117 | 34 | 0.51 | 0.57 |
| (GE-F) (75/25) | cold/dry | | 660 | 137 | | 0.64 | 0.33 |
| BX-55Z/P | Ambient | 1.37 | 663 | 97 | 22 | 0.40 | 0.60 |
| (GE-F) (50/50) | cold/dry | | 662 | 120 | | 0.49 | 0.33 |
| BX-55Z/P | Ambient | 1.35 | 663 | 98 | 18 | 0.71 | 0.58 |
| (GE-F) (25/75) | cold/dry | | 662 | 130 | | 0.39 | 0.29 |

*Ambient: 72° F./40% Relative Humidity (RH)
**Cold/Dry: 60° F. /08% RH
Discharge Voltage corresponds to voltage at energy of 0.23 uJ/cm2

TABLE 7

Electrical Characteristics of Epoxy Novolac Resin Based CG with Benzidine Transport (45% Pigment concentration)

| Binder | Environment | Optical Density (O.D.) | Charge (−V) | Discharge (−V) | Dark Decay (V/sec) | Back ground | Isopel O.D. |
|---|---|---|---|---|---|---|---|
| BM-S | Ambiemt | 1.21 | 658 | 117 | 20 | 0.77 | 0.43 |
| | cold/dry | | 660 | 187 | | 0.66 | 0.23 |

TABLE 7-continued

Electrical Characteristics of Epoxy Novolac Resin Based CG with Benzidine Transport (45% Pigment concentration)

| Binder | Environment | Optical Density (O.D.) | Charge (−V) | Discharge (−V) | Dark Decay (V/sec) | Back ground | Isopel O.D. |
|---|---|---|---|---|---|---|---|
| BM-S/P (GE-DCP) (90/10) | Ambient | 1.29 | 662 | 102 | 17 | 0.58 | 0.46 |
| | cold/dry | | 662 | 138 | | 0.53 | 0.28 |

It may be argued that the increased sensitivity and decreased dark decay are due to the use of a lower molecular weight binder in the CG. The advantage derived is that, whereas the epoxy novolac resin as a CG binder (100%) results in an unstable dispersion, and the use of a PVB as a CG binder results in lower sensitivity, the combination of the polymers results in a stable dispersion and optimum electricals. While the use of a low molecular weight PVB may result in increased sensitivity (BM-S Vs BX-55Z), it is clear that the blend involving the epoxy resin increases the sensitivity irrespective of the molecular weight of the PVB binder. The use of a low molecular weight PVB often results in CG wash, during the CT coating. However, this problem is alleviated by the use of the epoxy novolac resin blend.

To further test the validity of this invention, formulations based on lower pigment level namely 25% and 35% were chosen, and photoconductor drums formulated. As seen in Tables 8 and 9, the theory that the use of the epoxy novolac resin blend in the CG results in improved electrical characteristics still holds.

To further explore the use of the epoxy resin CG, tests were carried out with a different charge transport molecule namely p-diethylaminobenzaldehyde diphenylhydrazone (DEH). Significant improvements in the electrical sensitivity were observed for formulations containing the epoxy novolac resin, both at 35% and 45% pigment levels. A summary of the results for the DEH system are given in Table 10. It may be noted that the DEH drums were not UV cured following the cure of the CT layer.

TABLE 10

Electrical Characteristics of Epoxy Novolac Resin Based CG with DEH Transport

| Binder | Environ-ment | Optical Density (O.D.) | Charge (−V) | Dis-charge (−V) | Dark Decay (V/sec) |
|---|---|---|---|---|---|
| BX-55Z (45% Pigment) | Ambient | 1.4 | 693 | 275 | 23 |
| BX-55Z/P (GE-co-DCP) (90/10) | Ambient | 1.42 | 692 | 141 | 20 |
| BX-55Z/P (GE-co-F) (90/10) | Ambient | 1.49 | 695 | 135 | 15 |

TABLE 8

Electrical Characteristics of Epoxy Novolac Resin Based CG with Benzidine Transport (35% Pigment concentration)

| Binder | Environment | Optical Density (O.D.) | Charge (−V) | Discharge (−V) | Dark Decay (V/sec) | Back ground | Isopel O.D. |
|---|---|---|---|---|---|---|---|
| BM-55Z | Ambiemt | 1.4 | 660 | 275 | 70 | 0.61 | 0.29 |
| | 60/08 | | 665 | 310 | | 0.47 | 0.20 |
| BX-55Z/P | Ambient | 1.29 | 663 | 115 | 27 | 0.12 | 0.55 |
| (GE-DCP) (75/25) | 60/08 | | 665 | 147 | | 0.48 | 0.33 |
| BX-55Z/P | Ambient | 1.29 | 665 | 122 | 27 | 0.58 | 0.46 |
| (GE-F) (75/25) | 60/08 | | 665 | 160 | | 0.53 | 0.28 |

TABLE 9

Electrical Characteristics of Epoxy Novolac Resin Based CG with Benzidine Transport (25% Pigment concentration)

| Binder | Environment | Optical Density (O.D.) | Charge (−V) | Discharge (−V) | Dark Decay (V/sec) | Back ground | Isopel O.D. |
|---|---|---|---|---|---|---|---|
| BM-55Z | Ambiemt | 1.28 | 660 | 277 | 68 | 0.62 | 0.29 |
| | cold/dry | | 665 | 313 | | 0.35 | 0.18 |
| BX-55Z/P | Ambient | 1.34 | 662 | 197 | 60 | 0.11 | 0.41 |
| (GE-DCP) (75/25) | cold/dry | | 665 | 230 | | 0.47 | 0.25 |
| BX-55Z/P | Ambient | 1.38 | 663 | 202 | 40 | 0.35 | 0.42 |
| (GE-F) (75/25) | cold/dry | | 663 | 237 | | 0.41 | 0.25 |

TABLE 10-continued

Electrical Characteristics of Epoxy Novolac Resin Based CG with DEH Transport

| Binder | Environ-ment | Optical Density (O.D.) | Charge (−V) | Dis-charge (−V) | Dark Decay (V/sec) |
|---|---|---|---|---|---|
| BX-55Z (35% Pigment) | Ambient | 1.38 | 695 | 243 | 25 |
| BX-55Z/P (GE-co-DCP) (90/10) | Ambient | 1.41 | 695 | 162 | 18 |
| BX-55Z/P (GE-co-F) (90/10) | Ambient | 1.48 | 697 | 157 | 21 |

The epoxy resins used as blends were EPON 1001, 1004 and 1009 (Shell Chemicals ) with polyvinylbutyral (S-Lec-B [BX-55Z], Sekisui Chemical Co.). The EPON resins are epoxy capped polymers which are derivations of bisphenol and epichlorohydrin having weight average molecular weight of 4294, 6782, and 26,869 g/mol respectively. Formulations consisting of 45/55 and 35/65 pigment (oxotitanium phthalocyanine) to binder, showed improved dark decay and electrical characteristics when the PVB binder was blended with epoxy novolac resin. The blends were prepared at weight ratios of, 75/25, 25/75 and 10/90 of the PVB to the epoxy resin. All stable formulations resulted in good coating quality. The CG layers involving the above formulations were typically cured at 100° C. for 5 min. The charge transport (CT) layers coated on the CG layers were benzidine-polycarbonate and cured at 120° C. for 1 h, to a coat weight of about 20 mg/in2. The electrical characteristics of drums coated with the above formulations are given in Table 11.

TABLE 11

Electrical Characteristics of Epoxy Resin (EPON 1004) CG Blends with Benzidine Transport (45% Pigment and 30% Transport concentrations)

| CG BINDER (CURE) | Optical Density | Dark Decay (V/sec) | Charge Voltage ($-V_0$) | $V_{0.23}$ (−V) |
|---|---|---|---|---|
| BX-55Z | 1.68 | 20 | 698 | 190 |
| BX-55Z/EPON 1004 (75/25) | 1.48 | 14 | 695 | 88 |
| BX-55Z/EPON 1004 (75/25) | 1.35 | 10 | 700 | 132 |
| BX-55Z/EPON 1004 (25/75) | 1.34 | 9 | 699 | 148 |
| BX-55Z/EPON 1004 (10/90) | 1.34 | 9 | 696 | 187 |

$V_{0.23}$: Voltage at an Energy of 0.23 uJ/cm2

TABLE 12

Electrical Characteristics of Epoxy Resin (EPON 1004) CG Blends with Benzidine Transport (35% Pigment and 30% Transport concentrations)

| CG BINDER (CURE) | Optical Density | Dark Decay (V/sec) | Charge Voltage ($-V_0$) | $V_{0.23}$ (−V) |
|---|---|---|---|---|
| BX-55Z | 1.29 | 45 | 684 | 237 |
| BX-55Z/EPON 1004 (75/25) | 1.82 | 42 | 686 | 156 |
| BX-55Z/EPON 1004 (75/25) | 1.33 | 23 | 696 | 141 |
| BX-55Z/EPON 1004 (25/75) | 1.61 | 19 | 698 | 81 |
| BX-55Z/EPON 1004 (25/75) | 1.3 | 15 | 695 | 161 |
| BX-55Z/EPON 1004 (10/90) | 1.34 | 13 | 693 | 134 |
| BX-55Z/EPON 1004 (10/90) | 1.23 | 9 | 694 | 194 |

$V_{0.23}$: Voltage at an Energy of 0.23 uJ/cm2

It is hence clear from the tables 11 and 12, that the use of BX-55Z/EPON blends results in a photoconductor with highly improved electrical characteristics of an electrophotographic photoreceptor. The results were identical for the use of the PVB/Epoxy resin CG formulations with different transports in the charge transport layer, such as diethylaminobenzaldehyde diphenylhydrazone (DEH) and dipheny-laminobenzaldehyde diphenylhydrazone (TPH).

FORMULATION OF PHENOXY RESIN

COMPARATIVE EXAMPLE 1

A charge generation formulation consisting of a 45/55 pigment/binder ratio was prepared as follows:

Oxotitanium phthalocyanine (7.4 g), polyvinylbutyral (BX-55Z, Sekisui Chemical Co., 9.00 g) with Potter's glass beads (60 ml) was added to a mixture of 2-butanone (50 g) and cyclohexanone (50 g), in an amber glass bottle, and agitated in a paint-shaker for 12 h and diluted to about 3% solids with 2-butanone (400 g). An anodized aluminum drum was then dip-coated with the CG formulation and dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The CG layer coated drums were dip-coated in the CT formulation, dried at 120° C. for 1 h, to obtain a coat weight of about 20 mg/in2. The electrical characteristics of this drum were: Charge voltage (Vo): −683 V, residual voltage (Vr): −80 V, dark decay: 24 V/sec, Voltage at E(0.23 uJ/cm2) of −135 V.

COMPARATIVE EXAMPLE 2

A formulation involving BM-S as the PVB binder at 45/55 pigment binder ratio was prepared as follows:

Oxotitanium phthalocyanine (7.4 g), polyvinylbutyral (BM-S, Sekisui Chemical Co., 9.00 g) with Potter's glass beads (60 ml) was added to a mixture of 2-butanone (50 g) and cyclohexanone (50 g), in an amber glass bottle, milled for 12 h and diluted to about 3% solids with 2-butanone (400 g). An anodized aluminum drum was then dip-coated with the CG formulation and dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The CG layer coated drums were dip-coated in the CT formulation, dried at 120° C. for 1 h, to obtain a coat weight of about 20 mg/in2. The electrical characteristics of this drum were: Charge voltage (Vo): -689 V, residual voltage (Vr): −60 V, dark decay: 20 V/sec, Voltage at E(/0.23 uJ/cm2): −120 V.

COMPARATIVE EXAMPLE 3

A formulation involving BX-55Z as the PVB binder at 35/65 pigment binder ratio was prepared as follows:

Oxotitanium phthalocyanine (4.0 g), polyvinylbutyral (BX-55Z, 8.12 g) with Potter's glass beads (60 ml) was added to a mixture of 2-butanone (50 g) and cyclohexanone (50 g), in an amber glass bottle, agitated in a paint-shaker for 12 h and diluted to about 3% solids with 2-butanone (400 g). An anodized aluminum drum was then dip-coated with the CG formulation and dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The C/G layer coated drums were dip-coated in the CT formulation, dried at 120° C. for 1 h, to obtain a coat weight of about 20 mg/in2. The electrical characteristics of this drum were: Charge voltage (Vo): −683 V, residual voltage (Vr): −140 V, dark decay: 51 V/sec, Voltage at E(0.23 uJ/cm2): −256 V.

EXAMPLE 1

A typical formulation involving a BX-55Z/phenoxy resin (75/25) at 45/55 pigment/binder ratio was prepared as follows:

Oxotitanium phthalocyanine (7.4 g), polyvinylbutyral (BX-55Z, 6.820 g), a phenoxy resin (PKHH, Phenoxy associates, 2.28 g) with Potter's glass beads (60 ml) was added to a mixture of 2-butanone (50 g) and cyclohexanone (50 g), in an amber glass bottle, agitated in a paint-shaker for 12 h and diluted to about 3% solids with 2-butanone (400 g). An anodized aluminum drum was then dip-coated with the CG formulation and dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The CG layer coated drums were dip-coated in the CT formulation, dried at 120° C. for 1 h, to obtain a coat weight of about 20.9 mg/in2. The electrical characteristics of this drum were: Charge voltage (Vo): −645 V, residual voltage (Vr): −110 V, dark decay: 22 V/sec, Voltage at E(0.23 uJ/cm2): −175 V.

EXAMPLE 2

A typical formulation involving a BX-55Z/phenoxy resin (25/75) at 45/55 pigment/binder ratio was prepared as follows:

Oxotitanium phthalocyanine (7.4 g), polyvinylbutyral (BX-55Z, 2.28 g), a phenoxy resin (PKHH, Phenoxy associates, 6.82 g) with Potter's glass beads (60 ml) was added to a mixture of 2-butanone (50 g) and cyclohexanone (50 g), in an amber glass bottle, agitated in a paint-shaker for 12 h and diluted to about 3% solids with 2-butanone (400 g). An anodized aluminum drum was then dip-coated with the CG formulation, air-dried for 1 minute and dip-coated in the CG layer and dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The CG layer coated drums were dip-coated in the CT formulation, dried at 120° C. for 1 h, to obtain a coat weight of about 21 mg/in2. The electrical characteristics of this drum were: Charge voltage (Vo): −693 V, residual voltage (Vr): −90 V, dark decay: 15 V/sec, Voltage at E(0.23 uJ/cm2): −112 V.

EXAMPLE 3

A typical formulation involving a BM-S/phenoxy resin (25/75) at 45/55 pigment/binder ratio was prepared as follows:

Oxotitanium phthalocyanine (7.4 g), polyvinylbutyral (BX-55Z, 6.820 g), a phenoxy resin (PKHH, Phenoxy associates, 2.28 g) with Potter's glass beads (60 ml) was added to a mixture of 2-butanone (50 g) and cyclohexanone (50 g), in an amber glass bottle, agitated in a paint-shaker for 12 h and diluted to about 3% solids with 2-butanone (400 g). An anodized aluminum drum was then dip-coated with the CG formulation, dried at room temperature for 1 min., dip-coated in the CG layer and dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The CG layer coated drums were dip-coated in the CT formulation, dried at 120° C. for 1 h, to obtain a coat weight of about 19.6 mg/in2. The electrical characteristics of this drum were: Charge voltage (Vo): −696 V, residual voltage (Vr): −73 V, dark decay: 14 V/sec, Voltage at E(0.23 uJ/cm2): −133 V.

PREPARATION OF EPOXY NOVOLAC BASED FORMULATIONS:

EXAMPLE 4

A typical formulation involving a BX-55Z/epoxy novolac resin (75/25) at 45/55 pigment/binder ratio was prepared as follows:

Oxotitanium phthalocyanine (7.42 g), polyvinylbutyral (BX-55Z, 6.80 g), an epoxy novolac resin (poly [(phenylglycidyl ether)-co-dicyclopentadiene] Aldrich Chemical Co., 2.27 g) with Potter's glass beads (60 ml) were added to a mixture of 2-butanone (75 g) and cyclohexanone (50 g), in an amber glass bottle, agitated in a paint-shaker for 12 h and diluted with 2-butanone (325 g). An anodized aluminum drum was then dip-coated with the CG formulation and dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The CG layer coated drums were dip-coated in the CT formulation, dried at 120° C. for 1 h, to obtain a coat weight of about 20.5 mg/in2. The electrical characteristics of this drum were: Charge voltage (Vo): −662 V, Voltage at E(0.23 uJ/cm2): −90 V and dark decay: 25 V/sec, .

EXAMPLE 5

A typical formulation involving a BM-S/epoxy novolac resin (75/25) at 45/55 pigment/binder ratio was prepared as follows:

Oxotitanium phthalocyanine (7.42 g), polyvinylbutyral (BM-S, 6.80 g), an epoxy novolac resin (poly [(phenylglycidyl ether)-co-dicyclopentadiene] Aldrich Chemical Co., 2.27 g) with Potter's glass beads (60 ml) were added to a mixture of 2-butanone (50 g) and cyclohexanone (75 g), in an amber glass bottle, agitated in a paint-shaker for 12 h and diluted with 2-butanone (325 g). An anodized aluminum drum was then dip-coated with the CG formulation, and dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The CG layer coated drums were dip-coated in the CT formulation, dried at 120° C. for 1 h, to obtain a coat weight of about 20 mg/in2. The electrical characteristics of this drum were: Charge voltage (Vo): −662 V, Voltage at E(0.23 uJ/cm2): −102 V and dark decay: 17 V/sec.

EXAMPLE 6

A typical formulation involving a BX-55Z/epoxy novolac resin (25/75) at 45/55 pigment/binder ratio and DEH transport was prepared as follows:

Oxotitanium phthalocyanine (9.38 g), polyvinylbutyral (BX-55Z, 8.59 g), an epoxy novolac resin (poly [(phenylglycidyl ether)-co-formaldehyde] Aldrich Chemical Co., 2.86g ) with Potter's glass beads (60 ml) were added to a mixture of 2-butanone (85 g) and cyclohexanone (40 g), in an amber glass bottle, agitated in a paint-shaker for 12 h and diluted with 2-butanone (275 g). An anodized aluminum drum was then dip-coated with the CG formulation, and dried at 100° C. for 5 min. The transport layer formulation was prepared from a bisphenol-A polycarbonate (MAKROLON-5208, Bayer, 37.6 g), DEH (37.10 g), PE-200 (4.58 g), acetosol yellow (0.68 g) in tetrahydrofuran (259.6g) and 1,4-dioxane (111.4 g). The CG layer coated drums were dip-coated in the CT formulation, dried at 120° C. for 1 h, to obtain a coat weight of about 16.1 mg/in2. The electrical characteristics of this drum were: Charge voltage (Vo): −695 V, Voltage at E(0.23 uJ/cm2): −135 V and dark decay: 15 V/sec, .

PREPARATION OF EPOXY RESIN BASED FORMULATIONS:

EXAMPLE 7

A typical formulation involving a BX-55Z/epoxy resin (75/25) at 45/55 pigment/binder ratio was prepared as follows:

Oxotitanium phthalocyanine (7.0 g), polyvinylbutyral (BX-55Z, 6.82 g), a epoxy resin (EPON 1004, Shell Co., 2.28 g) with Potter's glass beads (60 ml) was added to a mixture of 2-butanone (32 g) and cyclohexanone (32 g), in an amber glass bottle, agitated in a paint-shaker for 12 h and diluted to about 4.7% solids with 2-butanone (258 g). An anodized aluminum drum was then dip-coated with the CG formulation and dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The CG layer coated drums were dip-coated in the CT formulation, dried at 120° C. for 1 h, to obtain a coat weight of about 16 mg/in2. The electrical characteristics of this drum were: Charge voltage (Vo): −696 V, residual voltage (Vr): −48 V, dark decay: 14 V/sec, Voltage at E(0.23 uJ/cm2): −88 V.

EXAMPLE 8

A typical formulation involving a BX-55Z/epoxy resin (25/75) at 45/55 pigment/binder ratio was prepared as follows:

Oxotitanium phthalocyanine (7.0 g), polyvinylbutyral (BX-55Z, 2.28 g), a epoxy resin (EPON 1004, Shell Co., 6.82 g) with Potter's glass beads (60 ml) was added to a mixture of 2-butanone (32 g) and cyclohexanone (32 g), in an amber glass bottle, agitated in a paint-shaker for 12 h and diluted to about 4.7% solids with 2-butanone (258 g). An anodized aluminum drum was then dip-coated with the CG formulation and dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The CG layer coated drums were dip-coated in the CT formulation, dried at 120° C. for 1 h, to obtain a coat weight of about 16 mg/in2. The electrical characteristics of this drum were: Charge voltage (Vo): −699 V, residual voltage (Vr): −77 V, dark decay: 9 V/sec, Voltage at E(0.23 uJ/cm2): −148 V.

EXAMPLE 9

A typical formulation involving a BX-55Z/epoxy resin (75/25) at 35/65 pigment/binder ratio was prepared as follows:

Oxotitanium phthalocyanine (5.25 g), polyvinylbutyral (BX-55Z, 7.31 g), a epoxy resin (EPON 1004, Shell Co., 2.44 g) with Potter's glass beads (60 ml) was added to a mixture of 2-butanone (30g) and cyclohexanone (30 g), in an amber glass bottle, agitated in a paint-shaker for 12 h and diluted to about 5% solids with 2-butanone (240 g). An anodized aluminum drum was then dip-coated with the CG formulation, and dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The CG layer coated drums were dip-coated in the CT formulation, dried at 120° C. for 1 h, to obtain a coat weight of about 24 mg/in2. The electrical characteristics of this drum were: Charge voltage (Vo): −696 V, residual voltage (Vr): −80 V, dark decay: 23 V/sec, Voltage at E(0.23 uJ/cm2): −141 V.

EXAMPLE 10

A typical formulation involving a BX-55Z/epoxy resin (25/75) at 35/65 pigment/binder ratio was prepared as follows:

Oxotitanium phthalocyanine (5.25 g), polyvinylbutyral (BX-55Z, 2.44 g), a epoxy resin (EPON 1004, Shell Co., 7.31 g) with Potter's glass beads (60 ml) was added to a mixture of 2-butanone (30g) and cyclohexanone (30 g), in an amber glass bottle, agitated in a paint-shaker for 12 h and diluted to about 5% solids with 2-butanone (240 g). An anodized aluminum drum was then dip-coated with the CG formulation, dried at 100° C. for 5 min. The transport layer formulation was prepared from a bisphenol-A polycarbonate (MAKROLON-5208, Bayer, 62.30 g), benzidine (26.70 g) in tetrahydrofuran (249 g) and 1,4-dioxane (106 g). The CG layer coated drums were dip-coated in the CT formulation, dried at 120° C. for 1 h, to obtain a coat weight of about 24 mg/in2. The electrical characteristics of this drum were: Charge voltage (Vo): −698 V, residual voltage (Vr): −65 V, dark decay: 19 V/sec, Voltage at E(0.23 uJ/cm2): −81 V.

Variation from these specific implementations will be apparent and can be anticipated.

What is claimed is:

1. A photoconductive member comprising:

a conductive substrate;

a charge generation layer on the substrate and consisting essentially of a blend of oxotitanium phthalocyanine pigment, polyvinylbutyral and an epoxy capped polymer which is a derivative of bisphenol and epichlorohydrin and has a weight average molecular weight of from 6,782 to about 26,869, wherein the charge generation layer has a pigment to binder weight ratio of from 35/65 to 45/55, and wherein the epoxy capped polymer has a formula of:

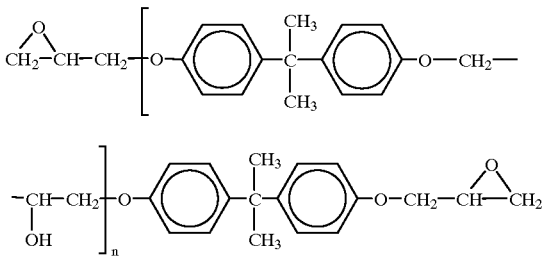

where n is an integer; and a charge transport layer on the charge generation layer and having a charge transport molecule dispersed therein.

2. The photoconductive member of claim 1, wherein the polyvinylbutyral and the epoxy capped polymer are included in the charge generation layer in a weight ratio of from about 75/25 to about 10/90 of polyvinylbutyral to epoxy capped polymer.

3. A photoconductive member comprising:

a conductive substrate;

a charge generation layer on the substrate and consisting essentially of a blend of oxotitanium phthalocyanine pigment, polyvinylbutyral and epoxy novolac resin, wherein the charge generation layer has a pigment to binder weight ratio of from 35/65 to 45/55, and wherein the epoxy novolac resin comprises poly((phenyleneglycidylether)-co-dicyclopentadiene) of a number average molecular weight of about 490 g/mol; and a charge transport layer on the charge generation layer and having a charge transport molecule dispersed therein.

4. The photoconductive member of claim 3, wherein the polyvinylbutyral and the epoxy novolac resin are included in the charge generation layer in a weight ratio of from about 90/10 to about 25/75 polyvinylbutyral to epoxy novolac resin.

* * * * *